US005751254A

United States Patent [19]

Bird et al.

[11] Patent Number: 5,751,254

[45] Date of Patent: May 12, 1998

[54] FEED MOVEMENT MECHANISM AND CONTROL SYSTEM FOR A MULTIBEAM ANTENNA

[75] Inventors: Trevor S. Bird; Mark A. Sprey, both of Sydney; Ian J. McInnes, Melbourne; Warren J. Hancock, Melbourne; Stephen R. Wilson, Melbourne, all of Australia

[73] Assignee: Commonwealth Scientific and Industrial Research Organisation, Campbell, Australia

[21] Appl. No.: 786,045

[22] Filed: Jan. 21, 1997

Related U.S. Application Data

[63] Continuation of PCT/AU95/00441, Jul. 20, 1995.

[30] Foreign Application Priority Data

Jul. 20, 1994 [AU] Australia ..... PM6953

[51] Int. Cl.[6] ..... H01Q 3/12

[52] U.S. Cl. ..... 343/761; 343/781 CA; 343/781 P; 343/840

[58] Field of Search ..... 343/761, 781 R, 343/781 P, 781 CA, 839, 840, 878, 882; 248/183, 184, 185, 186

[56] References Cited

U.S. PATENT DOCUMENTS

| | | | |
|---|---|---|---|
| 2,976,533 | 3/1961 | Salisbury | 343/761 |
| 3,832,715 | 8/1974 | Afifi et al. | 343/761 |
| 3,988,736 | 10/1976 | Smith, Jr. et al. | 343/761 |
| 5,283,591 | 2/1994 | Delmas | 343/761 |
| 5,576,721 | 11/1996 | Hwang et al. | 343/781 P |

FOREIGN PATENT DOCUMENTS

| | | |
|---|---|---|
| 2 227 610 | 8/1990 | United Kingdom . |
| 2 250 135 | 5/1992 | United Kingdom . |

OTHER PUBLICATIONS

English Abstract of Keiji et al Japanese laid open Application No. 03164108, Jul. 1991.

English Abstract of Osamu Japanese laid open Application No. 03327029, Nov. 1991.

English Abstract of Kyoko et al laid open Application No. 01098312, Apr. 1989.

*Primary Examiner*—Donald T. Hajec
*Assistant Examiner*—Tan Ho
*Attorney, Agent, or Firm*—Cushman, Darby & Cushman IP Group of Pillsbury Madison & Sutro LLP

[57] ABSTRACT

A feed transport device for moving a feed within a non-planar focal surface defined by a satellite communications antenna, comprises first and second non-linear rails, and a feed transport unit comprising a feed support member for supporting the feed, and first and second slidable members slidably mounted on said first and second rails respectively to permit each slidable member to slide along the length of its respective rail, wherein one end of the feed support member is pivotally attached, not necessarily about a single pivot axis, to the first slidable member, the other end of the feed support member is both slidably and pivotally, again not necessarily about a single axis, attached to the second slidable member, and the first and second rails are shaped and positioned to maintain the feed in, or near to, said focal plane during movement of the feed support member along the first and second rails. The feed support is provided with transverse sliding rail and a gimbal allows rotation about two perpendicular axes. The shape and position of the first and second rails and the orientation of the feed support member are chosen so as to ensure that the minimum of adjustment of the feed by the servos is required as the feed is moved along the length of the focal surface.

21 Claims, 5 Drawing Sheets

FEED MOVEMENT MECHANISM AND CONTROL SYSTEM FOR A MULTIBEAM ANTENNA

This is a continuation of: International Appln. Ser. No. PCT/AU95/00441 filed Jul. 20, 1995 which designated the U.S.

TECHNICAL FIELD OF THE INVENTION

The invention relates to the movement of feeds within a non-planar focal surface defined by a satellite communications antenna.

BACKGROUND OF THE INVENTION

In order to communicate simultaneously with a number of geostationary satellites it is known to use a single multibeam antenna comprising a concave primary reflector, a convex or concave secondary reflector, and a number of transceiver horns, referred to hereinafter simply as feeds, located on the focal surface of the antenna, which lies on the primary reflector side of the secondary reflector. The two reflectors are arranged in an offset Cassegrain or Gregorian configuration, and a separate feed is provided for each satellite which is to be accessed. Such an arrangement has a number of advantages over systems in which a separate antenna is used for each satellite. For example, in order to access additional satellites it is simply necessary to add one additional feed for each extra satellite, which is less expensive than adding additional reflector antennae. Furthermore, in view of the fact that only one antenna is required, the whole system is substantially lighter in weight, and can therefore be conveniently installed on a rooftop. In addition, each satellite can be tracked by simply moving the appropriate feed rather than, as was the case with conventional earth stations, moving the entire antenna structure.

However, one difficulty with the multibeam antenna described above is that the focal surface is generally not planar, and can be quite complex in shape. It is therefore necessary to move the feeds in a complicated manner in order to ensure that they remain within the non-planar focal surface. A further problem arises from the fact that geostationary satellites perform diurnal oscillations, and the feeds need to be moved appropriately in order to track the diurnal motion of the satellites.

The focal surface is unique to every multibeam antenna. It may be calculated from an electromagnetic field analysis of the antenna by standard methods. An objective in the design of the focal surface is to attempt to minimise its extent so that the volume in which a given transceiver may need to be moved is minimised.

The invention has arisen from attempts to overcome the above difficulties.

SUMMARY OF THE INVENTION

According to one aspect of the invention there is provided a feed transport device for moving a feed within a non-planar focal surface defined by a satellite communications antenna, the feed transport device comprising first and second non-linear rails, and a feed transport unit comprising a feed support member for supporting the feed, and first and second slidable members slidably mounted on said first and second rails respectively to permit each slidable member to slide along the length of its respective rail, wherein one end of the feed support member is pivotally attached, not necessarily about a single pivot axis, to the first slidable member, the other end of the feed support member is both slidably and pivotally, again not necessarily about a single axis, attached to the second slidable member, and the first and second rails are shaped and positioned to maintain the feed in, or near to, said focal plane during movement of the feed support member along the first and second rails.

In accordance with a second aspect of the present invention, a method of moving an antenna feed horn is also disclosed.

It will be appreciated by those skilled in the art that the provision of first and second non-linear rails of the appropriate shape ensures that the minimum of adjustment to the position of the feed is required in order to maintain the feed in the focal surface of the antenna system as the slidable members move along the rails.

Conveniently, the feed support member is pivotally attached to either the first slidable member or the second slidable member by means of a ball and socket, or universal, joint.

Preferably, the feed support member is connected to either the first slidable member or the second slidable member by means of a torsion joint, which allows the feed support member to pivot freely, but does not allow the feed support member to rotate about a hypothetical axis extending between the first and second slidable members.

The provision of such joints, together with a fact that the feed support member is also slidably attached to the second slidable member, allows the feed support member to be moved in a particularly flexible manner. For example, if required, the first and second slidable members can be moved along their respective rails for a short distance in opposite directions, or at different speeds, and the change in the orientation of the support member is accommodated by the joints.

In one embodiment of the invention, the spacing between the first and second rails varies along their lengths.

In such a case, it will be appreciated that the resultant change in distance between the first and second slidable members, as they move along the rails, is accommodated by the fact that the feed support member is slidably attached to the second slidable member.

Preferably, the feed transport unit further comprises a feed support adapted to support the feed, the feed support being slidably connected to the feed support member so as to allow the feed to slide, in use, along at least a portion of the length of the feed support member between the first and second rails.

Preferably, the feed support is provided with transverse sliding means for allowing the feed to slide, in use, in a direction which is generally perpendicular to said focal plane.

For example, in a preferred embodiment of the invention, the feed support is provided with a feed support rail, along which the feed can slide, and which is itself slidable along, and generally perpendicular to, the feed support member.

It will be appreciated that, as a result of the extra degree of freedom provided by this the transverse sliding means, the feed transport device allows the feed to cover substantially the whole area of the focal surface.

Advantageously, the feed support is provided with gimbal means for pivotally mounting the feed, with respect to the feed support member, about a pair of substantially perpendicular axes in order to allow the direction of the feed to be varied without movement of the first and second slidable members along the first and second rails.

Preferably, the movement of the feeds is entirely controlled by computer, and suitable driving arrangements are provided for driving, under the control of the computer, the first and second slidable members, the feed support, the transverse sliding means, and the gimbal means.

Conveniently, the first and second rails extend along smoothly curved arcuate paths. The arcuate paths need not, of course, be circularly arcuate.

In one embodiment of the invention, the first and second rails both curve in one, and the same, direction, but with different rates of curvature.

If required in order to allow the movement of the feed by the transport device to better match the shape of the focal surface, the angle of inclination of the feed support member, with respect to the horizontal, may vary as the feed support member is moved along the first and second rails.

Conveniently, the support member comprises two substantially parallel elongate members, extending at least part of the way between the first and second slidable members, and mounting means for mounting the feed between the two elongate members.

This feature reduces the torque exerted by the weight of the feed on the feed support member.

The invention also provides a multiple feed transport device for moving a plurality of feeds within a non-planar focal surface defined by a satellite communications antenna, the multiple feed transport device comprising first and second rails as described above, and a plurality of feed transport units, each adapted to support a respective feed, and each having the features described above.

Preferably, the multiple feed transport device comprises detection means for detecting when any two adjacent feed transport units move to within a specified distance of each other, and control means connected to said detection means for preventing the relevant slidable members from moving said two feed transport units still closer together.

The invention also provides a satellite communications antenna system comprising at least two reflectors defining a non-planar focal surface, a plurality of feeds, and a multiple feed transport device as described above.

The two reflectors of the satellite communications antenna system can be arranged in an offset Cassegrain or Gregorian configuration.

In this case, one of the reflectors can be a concave primary reflector, and the other reflector can be a convex or a concave secondary reflector.

The satellite communications antenna system can further comprise a radome cover for the feed transport device to keep out dust and moisture.

A preferred embodiment of the invention will now be described, by way of example only, with reference to the accompanying drawings.

PREFERRED EMBODIMENTS OF THE INVENTION

Figure 1:
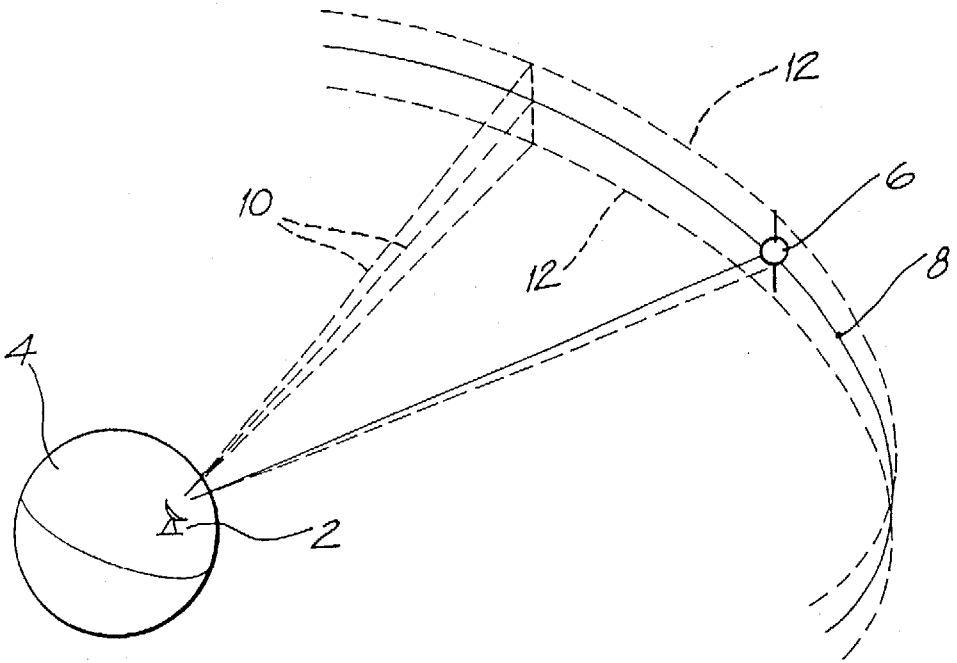
FIG. 1 is a perspective view of the earth, showing possible paths for geostationary satellites.

FIG. 1 shows a satellite communications antenna 2 located on the earth 4 for communication with a geostationary satellite 6 located in a geostationary orbit 8. The position of the satellite 6 at an earlier time is shown by the dotted lines 10. The satellite 6 performs natural diurnal oscillations away from its "true" orbital path 8, between the two limits indicated by dotted lines 12. The result of these oscillations is that the satellite 6, when viewed from the antenna 2 on the earth 4, appears to move along the figure-of-eight path 14 shown in FIG. 2. This diurnal motion of the satellite 6 must be tracked by the antenna 2 in order to maintain proper contact with the satellite 6.

Figure 3:
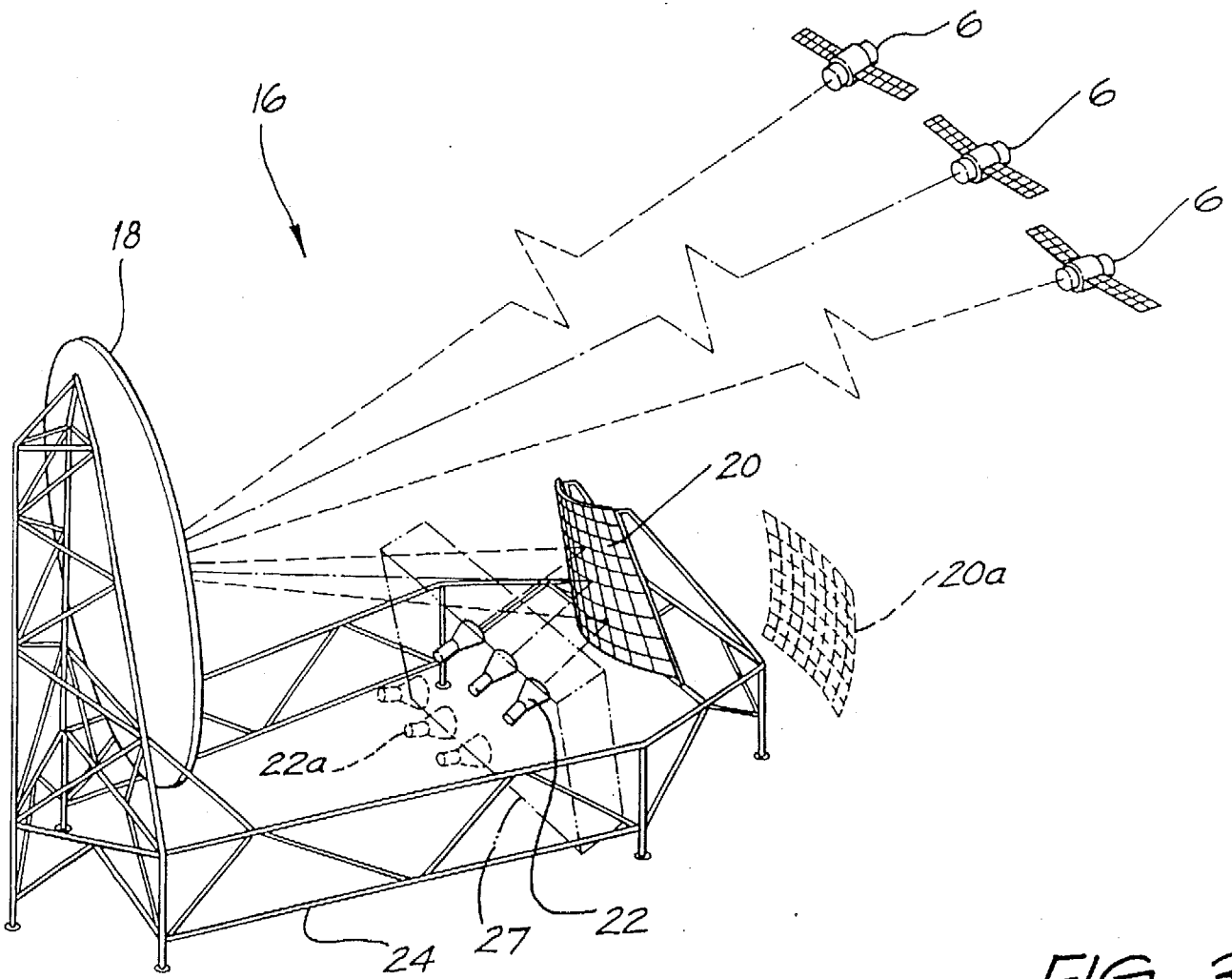
FIG. 3 is a schematic perspective view of a multibeam satellite communications antenna system.
Figure 4:
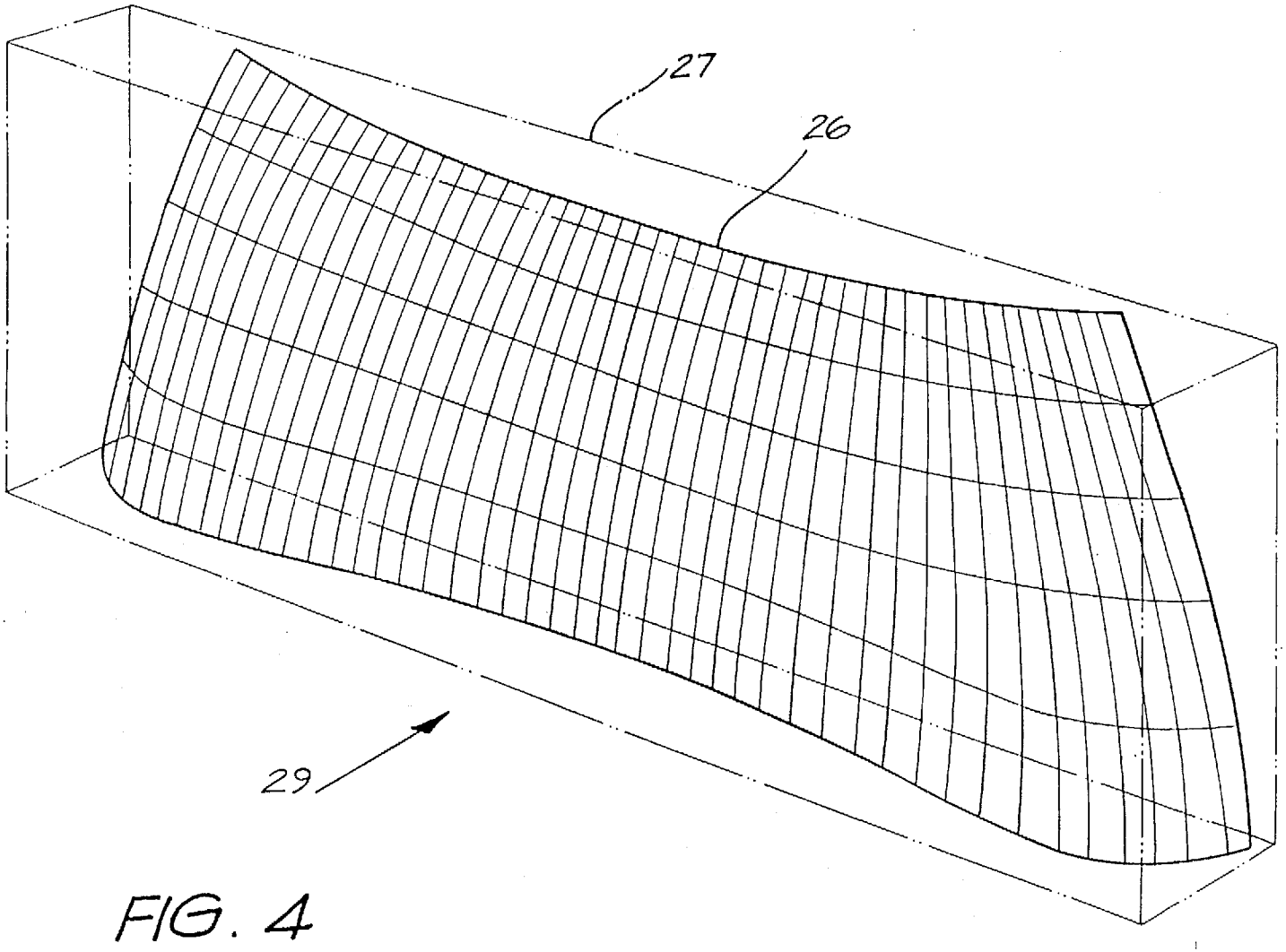
FIG. 4 is a schematic perspective view of the focal surface of the antenna system of FIG. 3.
Figure 7:
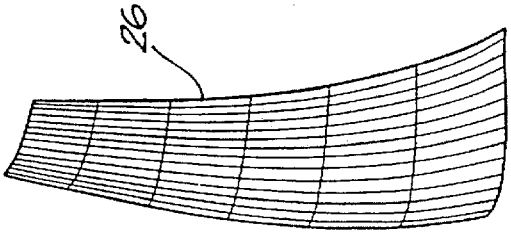
FIG. 7 is a side elevation of the focal surface of FIG. 4.
Figure 5:
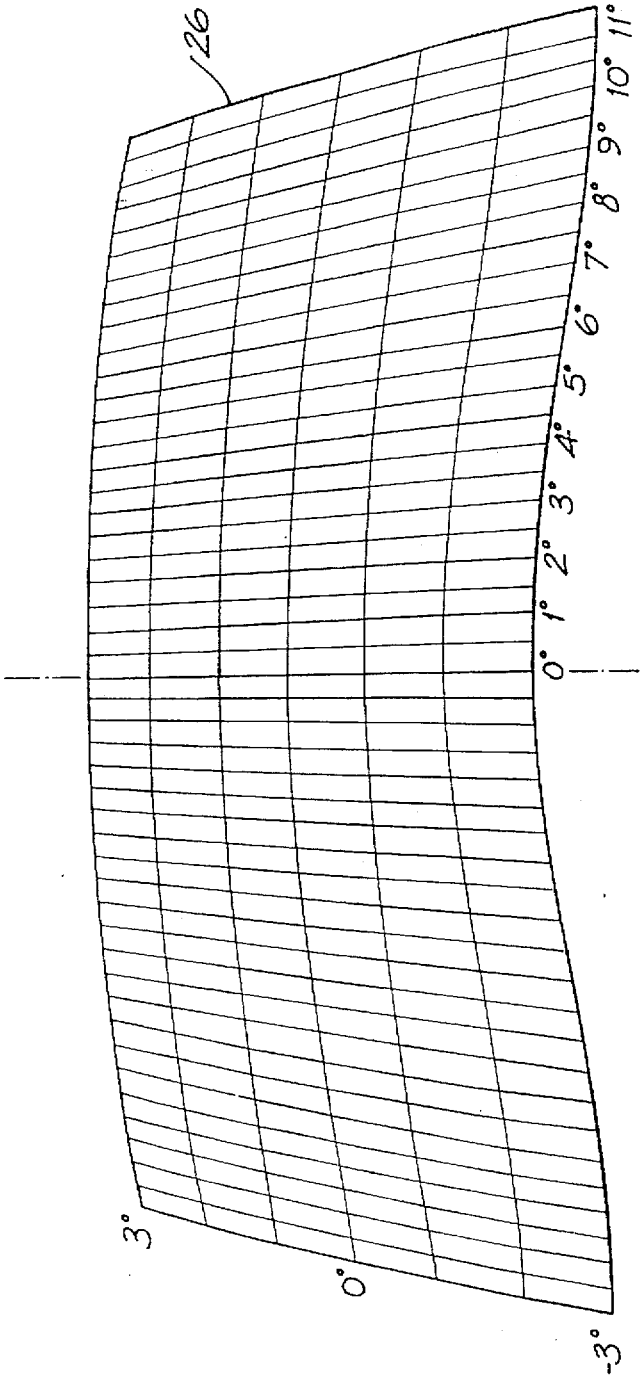
FIG. 5 is a front elevation of the focal surface of FIGS. 4.
Figure 6:
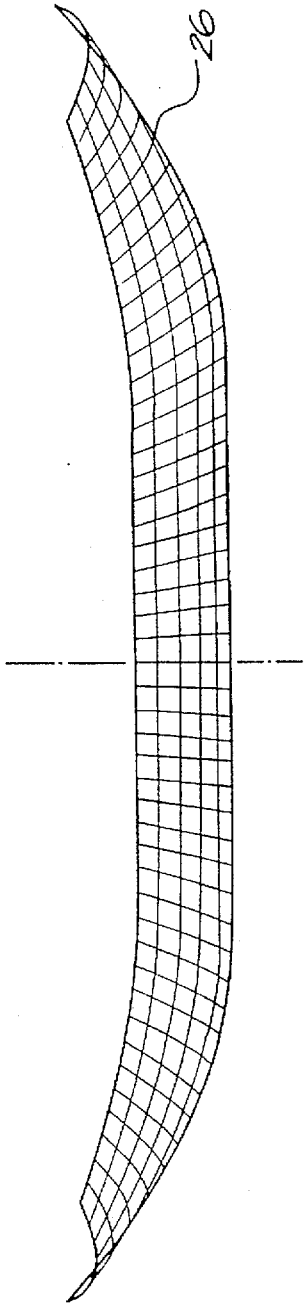
FIG. 6 is a plan view of the focal surface of FIG. 4.

FIG. 3 shows an antenna system 16 which can be used to track a number of geostationary satellites 6. The antenna system 16 comprises a concave main reflector 18, a convex subreflector 20, and a number of feeds 22 arranged between the main reflector 18 and the subreflector 20. The main reflector 18, subreflector 20 and feeds 22 are supported by a frame 24 in such a way that the feeds 22 lie in the focal surface of the antenna system 16, which lies between the two reflectors 18 and 20. Shown dotted is a concave secondary reflector **20*a* for a Gregorian configuration. The locations of the feeds 22 in the case of a Gregorian configuration are also indicated in dotted form at 22*a*. The focal surface 26 of the antenna system 16 lies within a volume indicated by the dotted box 27, and is shown in greater detail in FIGS. 4 to 7**.

As shown in FIGS. 4 to 7, the focal surface 26 of the antenna system 16 is non-planar. The direction towards the main reflector 18 is indicated by arrow 29. In order to track the diurnal motions of the satellites 6, the feeds 22 must be moved to various different locations on the focal surface 26. The need to move the feeds 22 within the focal surface 26 also arises if it is required to track different satellites 6 using the same feed 22, for example in the event of failure of one of the feeds 22.

Figure 2:
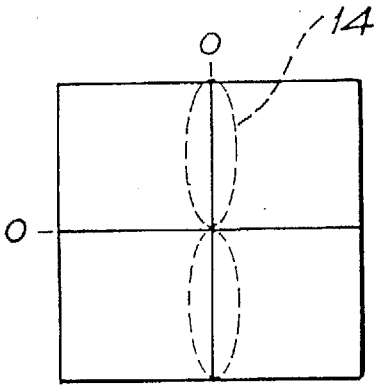
FIG. 2 illustrates the diurnal motion of a geostationary satellite.

In tracking a given satellite during its diurnal motion, FIG. 2, the amount of movement required to be made by the feed horn is relatively small providing the support member is approximately parallel to the vertical lines drawn on the focal surface 26. This objective is achieved by providing separate servos on the top and bottom rails.

Figure 8:
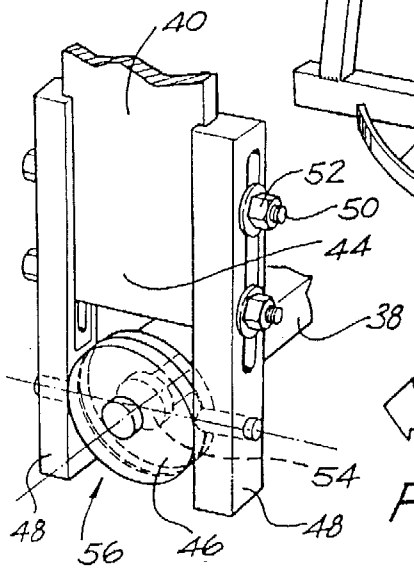
FIG. 8 is a rear perspective view of the feed transport device of the preferred embodiment.

FIG. 8 shows a feed transport device 27 for moving the feeds 22 to different locations on the focal surface 26. Referring to FIG. 8, first and second arcuate rails 28 and 30 respectively, are each supported, generally parallel to each other, by a frame 32 and a number of cross pieces 34. A first slidable member 36 is slidably mounted on the first, or upper, rail 28, and a second slidable member 38 is slidably mounted on the second, or lower, rail 30. An elongate, feed support member 40, generally perpendicular to the first and second arcuate rails 28 and 30, is connected at its upper and lower ends 42 and 44 to the first and second slidable members 36 and 38 respectively.

Figure 9:
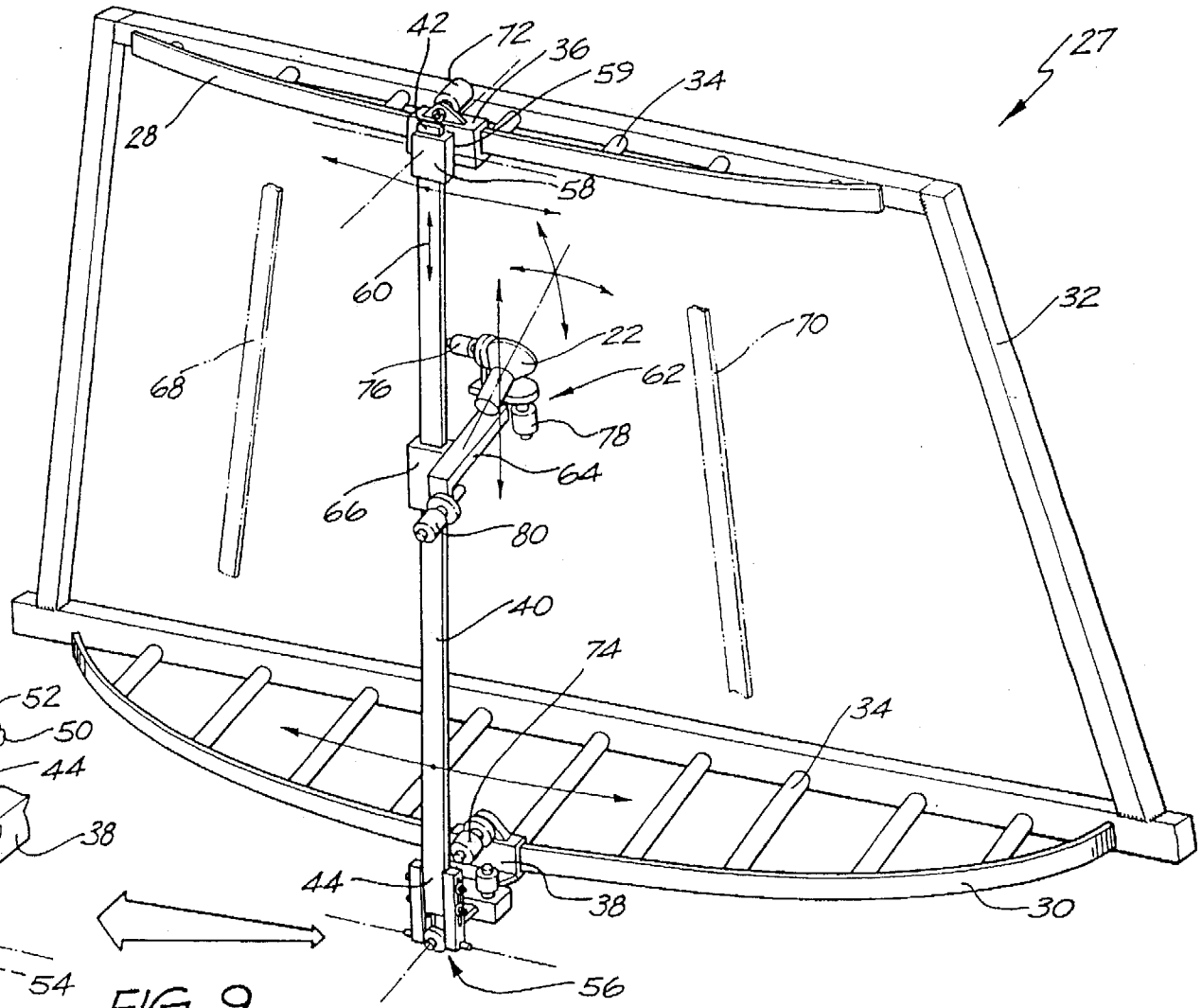
FIG. 9 shows the lower end of the feed support member of the feed transport device in greater detail.

The manner in which the feed support member 40 is connected to the second slidable member 38 is illustrated in greater detail in FIG. 9. A disc 46 is attached to the lower end 44 of the feed support member 40 by means of a pair of struts 48 bolted to the sides of the feed support member 40 by bolts 50 and nuts 52. The disc 46 is provided with a socket adapted to receive a ball 54 (shown in dotted lines) attached to the second slidable member 38. In short therefore, the lower end 44 of the feed support member 40 is attached to the second slidable member 38 by means of a ball and socket joint 56, which allows the feed support member 40 to pivot with respect to the second rail 30.

The upper end 42 of the feed support member 40 is slidably received within a bracket 58, which is itself connected to the first slidable member 36 by means of a torsion joint 59 (which is hidden behind the bracket 58 and is therefore not visible in FIG. 8). The torsion joint 59, which can be of any suitable known type, allows the feed support member 40 to pivot, with respect to the first slidable member 36, about two perpendicular axes (one of the axes being generally parallel with the first arcuate rail 28, and the other being generally perpendicular to both the first arcuate rail 28 and the feed support member 40), but does not allow the feed support member 40 to rotate about its longitudinal axis. The torsion joint 59 thus provides the feed support member 40 with torsional rigidity. The bracket 58 allows the feed support member 40 to slide vertically up and down, as indicated by arrow 60, with respect to the first slidable member 36.

It will be appreciated that the manner in which the feed support member 40 is attached to the first and second slidable members 36 and 38 allows the feed support member 40 to move in a particularly versatile manner. For example, if required, the first and second slidable members 36 and 38 can be moved along the first and second rails 28 and 30 for a short distance in opposite directions, or at different speeds, and the change in the orientation of the feed support member 40 is accommodated by the two joints 56 and 59, as well as by slidable movement of the feed support member 40 within the bracket 58.

A feed 22 is mounted on a gimbal 62 which allows rotation of the feed 22 about a pair of substantially perpendicular axes in order to align the feed 22 with one of the satellites 6. The gimbal 62 is itself slidable along a transverse rail 64 which is arranged generally perpendicularly to the focal surface 26 of the antenna system. The transverse rail 64 is in turn supported by a feed support bracket 66 which is slidable along the length of the feed support member 40 in order to allow adjustment of the height of the feed 22.

Although FIG. 8 shows only one feed support member 40, any number of additional feed support members 40 can be mounted on the rails 28 and 30, each carrying a respective feed 22, in order to allow the antenna system to simultaneously track a number of satellites 6. Further feed support members are indicated in ghost outline at 68 and 70.

In operation, the movement of the feeds 22 is controlled entirely by computer, and a number of servos are provided to drive the various parts of the apparatus. In particular, two servos 72 and 74 drive the first and second slidable members 36 and 38 along the first and second rails 28 and 30 respectively. Two more servos 76 and 78 rotate the feed 22 about the two perpendicular axes of the gimbal 62, and an additional servo 80 drives the gimbal 62 along the length of the transverse rail 64. A further servo (not shown) is provided for driving the feed support bracket 66 up and down the feed support member 40.

The shape and position of the first and second rails 28 and 30 are chosen so as to ensure that the minimum of adjustment of the feed 22 (by the servos 76, 78 and 80) is required as the feed 22 is moved along the length of the focal surface 26 by the first and second slidable members 36 and 38.

It will be seen from FIG. 8 that the feed 22 is located a short distance away from the feed support member 40. In order to avoid the torque which is applied to the feed support member 40 as a result of the separation between the feed 22 and the feed support member 40, the feed 22 can be mounted, in an alternative (non-illustrated) embodiment of the invention, so that the central axis of the feed support member 40 passes through the feed 22. In such an alternative embodiment, the feed support member 40 is replaced by two spaced apart parallel bars, and the feed 22, together with the gimbal 62, is slidably mounted between the two bars.

It will be apparent for close satellite spacings that the feed support members, for example 40 and 70, will come close together. The feed support members can be designed to permit normal satellite tracking even with three or more satellites spaced one degree apart without the feed support members and associated feeds clashing together. The most likely cause of a clash would be during hand over from one satellite to an adjacent one, manual override, testing, or in the event of a control system or servo malfunction. The clash point is determined by the width of the feed support member 40 and the larger diameter of the horns of the feeds 22. Clashing may be avoided by installing a spring mounted buffer fitted with emergency stop microswitches. This is standard practice in similar robot installations in the automotive industry.

Such a feed horn buffer switch would be interlocked with a robot servo system and would shut down all adjacent feed horn drives in the event of a collision. A buffer and collision switch would also be fitted between the slidable members on the upper and lower rails 28 and 30.

The feed movement mechanism area is guarded to prevent entry of any personnel during operation. A full fence surrounding the equipment with a safety interlocked maintenance access gate is provided, but not illustrated. If this gate is opened during normal operation then all feed movement mechanisms shut down.

The control system requires six servos per feed transport device. The upper servo 72 is a slave of the lower servo 74 with a drive ratio that is determined from the focal surface in order to produce minimum movement of the feed support member 40.

The servo system can be coupled to a PC or other computer system via a variety of interfaces depending on the tracking system requirements.

The cables to the robot axes and feeds 22 can be carried in "rolling duct" type cable carriers (not shown), similar to large commercial gantry robots. These carriers maintain a constant bend radius and prevent adjacent cables from becoming tangled. A hanging catenary (not shown) can extend from the rear of the feed 22 to the slidable members 36 and 38 and then via a long "rolling duct" (not shown) to meet the travel requirements of the slidable members 36 and 38.

The presence of dust and rain in an open environment governs the life of the trackways and bearing systems. UV radiation combined with salt air also severely limits the life of plastics and rubber (e.g., cable sheaths and housings). For these reasons the robot system and feeds 22 are housed in an enclosure (not shown). An expensive radome is not required as the geometry enables a large flat rectangular microwave transparent sheet (not shown) to be mounted vertically in front of the feeds 22. This is a tension membrane suspended from the surrounding support structure. An enclosed feed movement mechanism also enables a lighter weight and therefore lower cost design, and considerably reduces the maintenance and running costs, as wind loads, rain, dust and high UV exposure are removed.

We claim:

1. A feed transport device for moving a feed within a non-planar focal surface defined by a satellite communications antenna, the feed transport device comprising first and second non-linear rails, and a feed transport unit comprising a feed support member for supporting the feed, and first and second slidable members slidably mounted on said first and second rails respectively to permit each slidable member to slide along, the length of its respective rail, wherein one end of the feed support member is pivotally attached, not necessarily about a single pivot axis, to the first slidable member, the other end of the feed support member is both slidably and pivotally, again not necessarily about a single axis, attached to the second slidable member, and the first and second rails are shaped and positioned to maintain the feed in, or near to, said focal surface during movement of the feed support member along the first and second rails.

2. A feed transport system as claimed in claim 1, wherein the feed support member is pivotally attached to either the first slidable member or the second slidable member by means of a ball and socket joint.

3. A feed transport system as claimed in claim 1, wherein the feed support member is pivotally attached to either the first slidable member or the second slidable member by means of an universal joint.

4. A feed transport system as claimed in claim 1, wherein the feed support member is connected to either the first slidable member or the second slidable member by means of a torsion joint, which allows the feed support member to pivot freely, but does not allow the feed support member to rotate about a hypothetical axis extending between the first and second slidable members.

5. A feed transport system as claimed in claim 4, wherein the spacing between the first and second rails varies along their lengths.

6. A feed transport system as claimed in claim 5, which further comprises a feed support adapted to support the feed, the feed support being slidably connected to the feed support member so as to allow the feed to slide, in use, along, at least a portion of the length of the feed support member between the first and second rails.

7. A feed transport system as claimed in claim 6, wherein the feed support is provided with transverse sliding means for allowing, the feed to slide, in use, in a direction which is generally perpendicular to said focal surface.

8. A feed transport system as claimed in claim 7, wherein the feed support is provided with a feed support rail, along which the feed can slide, and which is itself slidable along, and generally perpendicular to, the feed support member.

9. A feed transport system as claimed in claim 6, wherein the feed support is provided with gimbal means for pivotally mounting the feed, with respect to the feed support member, about a pair of substantially perpendicular axes in order to allow the direction of the feed to be varied without movement of the first and second slidable members along the first and second rails.

10. A feed transport system as claimed in claim 1, wherein the movement of the feed support member is entirely controlled by computer, and driving arrangements are provided for driving, under the control of the computer, at least the first and second slidable members.

11. A feed transport system as claimed in claim 5, wherein the first and second rails extend along smoothly curved arcuate paths.

12. A feed transport system as claimed in claim 5, wherein the first and second rails both curve in one, and the same, direction, but with different rates of curvature.

13. A feed transport system as claimed in claim 1, wherein the angle of inclination of the feed support member, with respect to the horizontal, varies as the feed support member is moved along the first and second rails.

14. A feed transport system as claimed in claim 1, wherein the feed support member comprises two substantially parallel elongate members, extending at least part of the way between the first and second slidable members, and mounting means for mounting the feed between the two elongate members.

15. A multiple feed transport device for moving a plurality of feeds within a non-planar focal surface defined by a satellite communications antenna, the multiple feed transport device comprising first and second non-linear rails, and a plurality of feed transport units each comprising:

a feed support member for supporting a respective feed, and first and second slidable members slidably mounted on said first and second rails respectively to permit each slidable member to slide along, the length of its respective rail, wherein one end of each feed support member is pivotally attached to one of the first slidable members, the other end of each feed support member is both slidably and pivotally attached to one of the second slidable members, and the first and second rails are shaped and positioned to maintain the feeds in, or near to, said focal surface during movement of the feed support members along the first and second rails.

16. A multiple feed transport device as claimed in claim 15, which further comprises detection means for detecting when any two adjacent feed transport units move to within a specified distance of each other, and control means connected to said detection means for preventing the relevant slidable members from moving said two feed transport units still closer together.

17. A satellite communications antenna system comprising at least two reflectors defining a non-planar focal surface, a plurality of feeds, and a multiple feed transport device for moving said plurality of feeds within said non-planar focal surface, said multiple feed transport device comprising first and second non-linear rails, and a plurality of feed transport units each including:

a feed support member for supporting a respective feed, and first and second sliceable members slidably mounted on said first and second rails respectively to permit each slidable member to slide along the length of its respective rail, wherein one end of each feed support member is pivotally attached to one of the first slidable members, the other end of each feed support member is both slidably and pivotally attached to one of the second slidable members, and the first and second rails are shaped and positioned to maintain the feeds, in or near to, said focal surface during movement of the feed support members along the first and second rails.

18. A satellite communications antenna system as claimed in claim 17, wherein the two reflectors are arranged in an offset Cassegrain or Gregorian configuration.

19. A satellite communications antenna system as claimed in claim 17 or 18, wherein one of the reflectors is a concave primary reflector, and the other reflector is a convex or a concave secondary reflector.

20. A satellite communications antenna system as claimed in claim 17 or 18, which further comprises a radome cover for the feed transport device to keep out dust and moisture.

21. A satellite communications antenna system as in claim 17 wherein said multiple feed transport device further comprises detection means for detecting when any two adjacent feed transport units move to within a specified distance of each other, and control means connected to said detection means for preventing the relevant slidable members from moving said two feed transport units still closer together.

* * * * *